US008081152B2

(12) United States Patent
Lu et al.

(10) Patent No.: US 8,081,152 B2
(45) Date of Patent: Dec. 20, 2011

(54) TIMING CONTROL CIRCUIT WITH POWER-SAVING FUNCTION AND METHOD THEREOF

(75) Inventors: Wen-Min Lu, Hsinchu (TW); Ming-Sung Huang, Hsinchu County (TW)

(73) Assignee: Etron Technology, Inc., Hsinchu (TW)

( * ) Notice: Subject to any disclaimer, the term of this patent is extended or adjusted under 35 U.S.C. 154(b) by 1068 days.

(21) Appl. No.: 11/941,091

(22) Filed: Nov. 16, 2007

(65) Prior Publication Data

US 2009/0108921 A1 Apr. 30, 2009

(30) Foreign Application Priority Data

Oct. 26, 2007 (TW) ..... 96140335 A

(51) Int. Cl.
*G09G 3/36* (2006.01)

(52) U.S. Cl. ..... 345/99; 345/211

(58) Field of Classification Search ..... 345/87–100, 345/201, 211

See application file for complete search history.

(56) References Cited

U.S. PATENT DOCUMENTS

| | | | | |
|---|---|---|---|---|
| 5,777,897 | A | 7/1998 | Giorgio | |
| 7,365,717 | B2 * | 4/2008 | Lee et al. | 345/100 |
| 2006/0066550 | A1 * | 3/2006 | Huang et al. | 345/92 |
| 2006/0279506 | A1 * | 12/2006 | Choi | 345/98 |
| 2007/0040826 | A1 * | 2/2007 | Lee et al. | 345/211 |

FOREIGN PATENT DOCUMENTS

| | | |
|---|---|---|
| EP | 0 701 207 A1 | 3/1996 |
| TW | 488543 | 5/2002 |
| TW | 200641749 | 12/2006 |
| TW | 200728972 | 8/2007 |
| TW | 200737460 | 10/2007 |

* cited by examiner

*Primary Examiner* — Regina Liang
(74) *Attorney, Agent, or Firm* — Winston Hsu; Scott Margo

(57) ABSTRACT

A timing control circuit with a power-saving function includes a receiving circuit, a processor, and a first switch. The receiving circuit receives a first set of differential signals for generating a set of command signals. The processor is coupled to the receiving circuit and generates a first control signal according to the set of command signals. The switch is coupled between the receiving circuit and the processor for selectively decoupling the receiving circuit from a first power supply according to the first control signal.

15 Claims, 5 Drawing Sheets

TIMING CONTROL CIRCUIT WITH POWER-SAVING FUNCTION AND METHOD THEREOF

BACKGROUND OF THE INVENTION

1. Field of the Invention

The present invention relates to a timing control circuit for an LCD and method thereof, and more particularly, to a timing control circuit with power-saving function for an LCD and method thereof.

2. Description of the Prior Art

Please refer to FIG. 1. FIG. 1 is a diagram illustrating an LCD 100. The LCD 100 comprises a timing control circuit 110, a data driving circuit 120, a gate driving circuit 130, and a pixel area 140. The timing control circuit 110 receives frame data externally, and respectively controls the data driving circuit 120 and gate driving circuit 130 according to the received frame data. The data driving circuit 120 transmits image signals to the pixel area 140. The gate driving circuit 130 transmits gate driving signals to the pixel area 140 to enable corresponding liquid crystal particles of the pixel receiving gate driving signals to rotate according to the image signals. In this way, frames can be displayed. Additionally, the interface between the timing control circuit 110 and the external devices is a Low Voltage Differential Signal (LVDS) interface. The interface between the timing control circuit 110, data driving circuit 120, and gate driving circuit 130 is a Reduced Swing Differential Signal (RSDS) interface. The above two interfaces carry voltage when enabled, which consumes power.

Please refer to FIG. 2. FIG. 2 is a diagram illustrating a valid pixel area of the pixel area 140. As shown in FIG. 2, the pixels of the pixel area 140 are not entirely displayed on the LCD because some pixels are covered by the edges of the LCD, which are invalid pixels. Those pixels that can be displayed on the LCD are valid pixels, which are defined by the vertical synchronous signal Vs and the horizontal synchronous signal Hs. Generally, the invalid pixels are called "porch," as the area covered by the widths of A, B, C, and D in FIG. 2. In the prior art, the porch is sent with black frame data, so that the porch still expresses a black frame with the corresponding grey level data.

However, the RSDS and LVDS interfaces still need to be enabled to transmit a grey level for black color to the invalid pixels according to the prior art. Therefore, the transmission lines of the RSDS and LVDS interfaces have to carry voltages, because the RSDS and LVDS interfaces transmit data in a differential manner. Hence, the LVDS interface between the timing control circuit 110 and the external devices, the RSDS interface between the timing control circuit 110 and the data driving circuit 120, and the RSDS interface between the timing control circuit 110 and the data driving circuit 130 have to remain enabled. In this way, even though a user cannot watch the black frames of the porch, the RSDS interface between the timing control circuit 110 and the data driving circuit 120, and the RSDS interface between the timing control circuit 110 and the data driving circuit 130 are still enabled, which wastes power.

SUMMARY OF THE INVENTION

The present invention provides a timing control circuit with a power-saving function. The timing control circuit comprises a receiving circuit receiving a first set of differential signals for generating a set of command signals; a processor, coupled to the receiving circuit for generating a first control signal according to the set of command signals; and a first switch coupled to the receiving circuit and the processor for selectively cutting off coupling between the receiving circuit and a first power supply according to the first control signal.

The present invention further provides a timing control circuit with a power-saving function. The timing control circuit comprises a processor for receiving a set of command signals and accordingly generating a second control signal; a transmitting circuit coupled to the processor; and a second switch coupled to the transmitting circuit and the processor for selectively cutting off coupling between the transmitting circuit and a second power supply.

The present invention further provides a method for controlling a timing control circuit. The timing control circuit comprises a receiving circuit. The method comprises (a) receiving a first set of differential signals for generating a set of command signals; (b) generating a first control signal according to the set of command signals; and (c) selectively cutting off coupling between the receiving circuit and a first power supply according to the first control signal.

The present invention further provides a method for controlling a timing control circuit. The timing control circuit comprises a transmitting circuit. The method comprises (a) generating a second control signal according to a set of command signals; and (b) selectively cutting off coupling between the transmitting circuit and a second power supply according to the second control signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
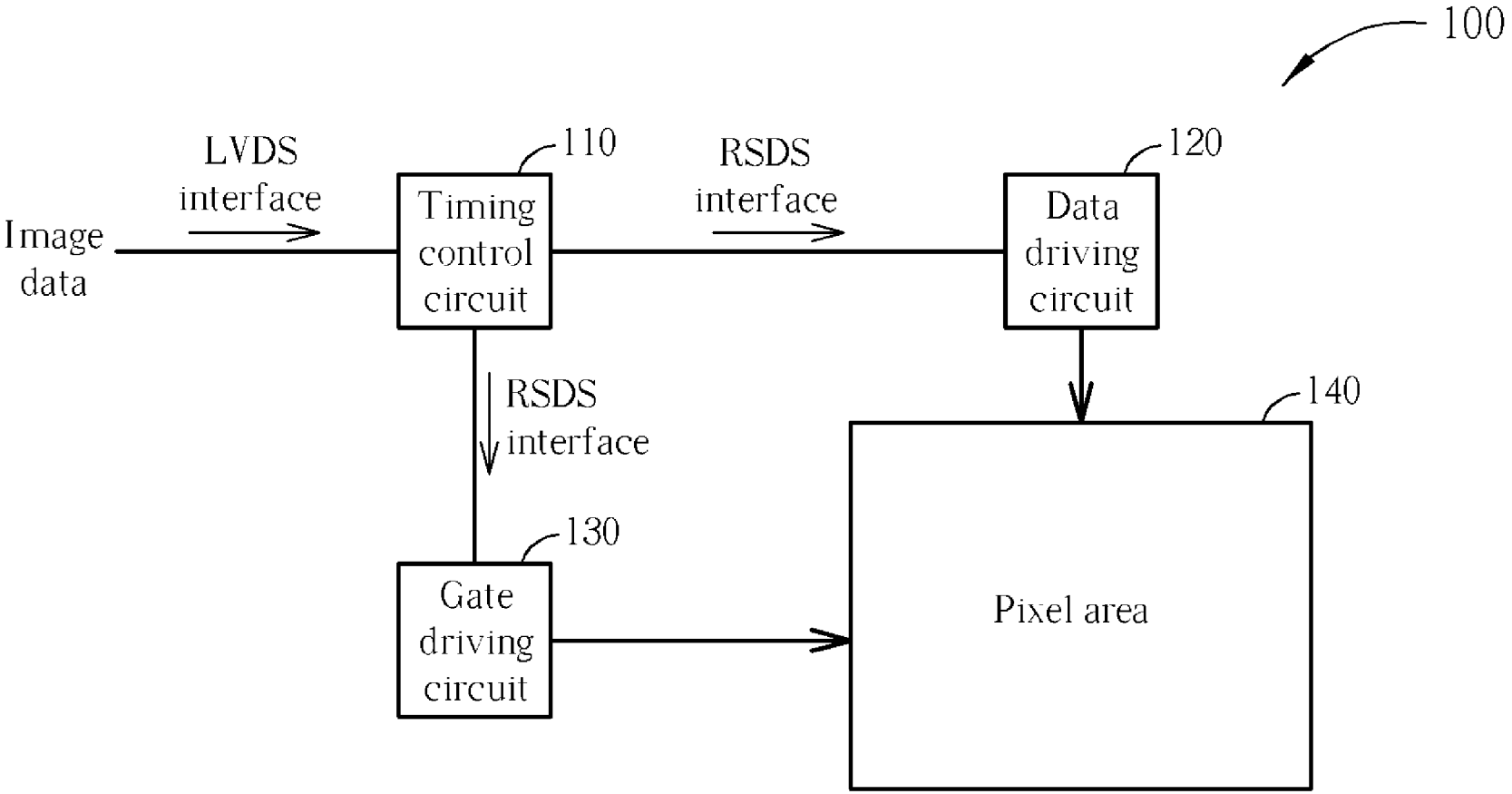
FIG. 1 PRIOR ART
FIG. 1 is a diagram illustrating an LCD.
Figure 2:
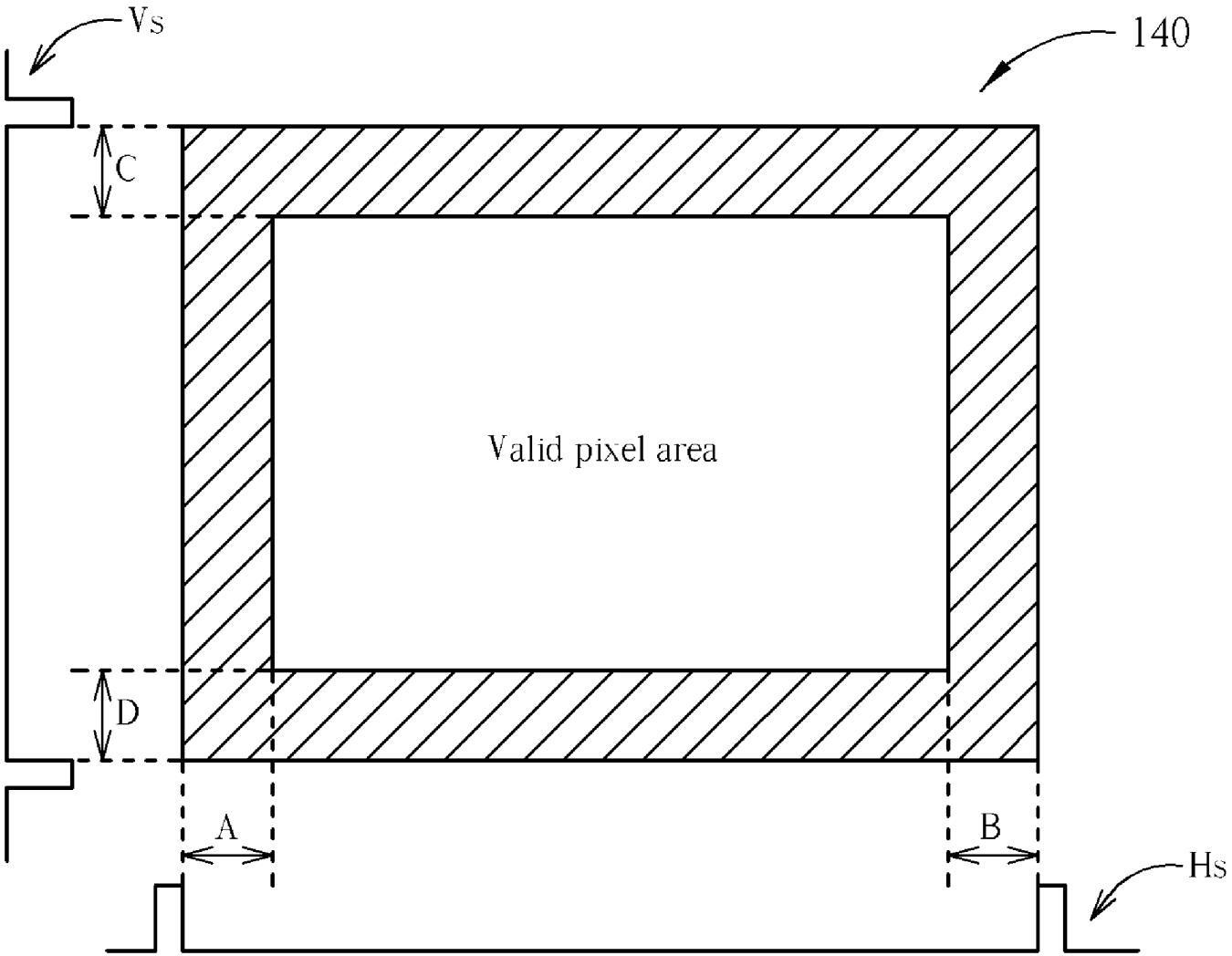
FIG. 2 PRIOR ART
FIG. 2 is a diagram illustrating a valid pixel area of a pixel area.
Figure 3:
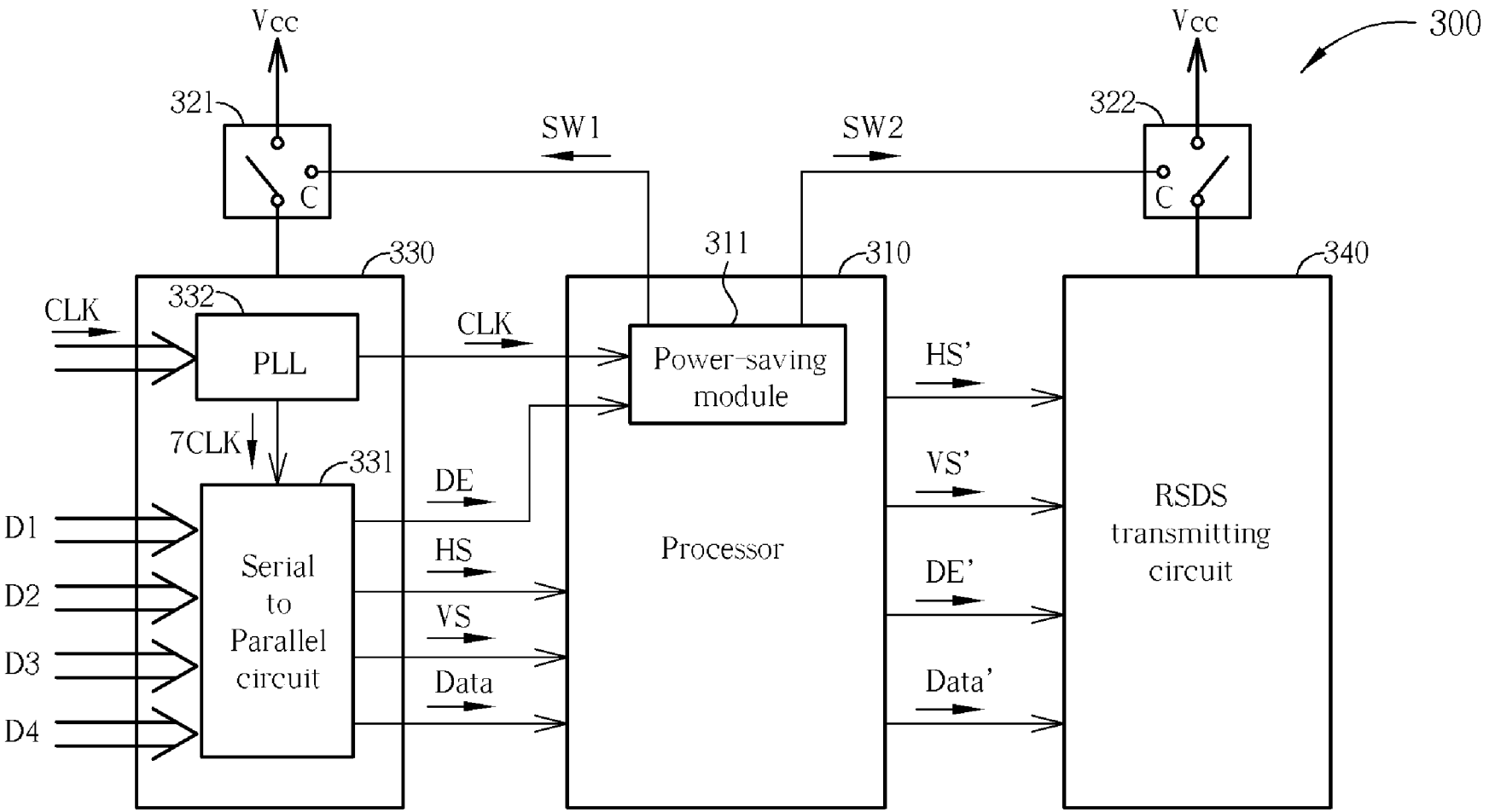
FIG. 3 is a diagram illustrating a timing control circuit with a power-saving function of the present invention.

Please refer to FIG. 3. FIG. 3 is a diagram illustrating a timing control circuit 300 with a power-saving function of the present invention. As shown in FIG. 3, the timing control circuit 300 comprises a receiving circuit 330, a transmitting circuit 340, a processor 310, and two switches 321 and 322. The receiving circuit 330 is coupled between an external LVDS interface and the processor 310. The receiving circuit 330 comprises a Phase Lock Loop (PLL) 332 and a serial-to-parallel circuit 331. The transmitting circuit 340 is coupled between the processor 310 and the internal RSDS interface. The processor 310 is coupled between the receiving circuit 330 and the transmitting circuit 340. The processor 310 comprises a power-saving module 311. The switch 321 is coupled between the receiving circuit 330, a power supply $V_{CC}$ and the processor 310. The switch 322 is coupled between the transmitting circuit 340, the power supply $V_{CC}$ and the processor 310.

In the receiving circuit 330, the serial to parallel circuit 331 receives four sets of differential signals D1~D4. Each set of differential signals D1~D4 is a packet. Each packet comprises seven data. The packet D1 comprises a timing command signal DE for indicating if the image data falls in the porch. The PLL 332 receives a set of differential signals CLK and accordingly generates a clock signal CLK and a clock signal 7CLK with seven times the frequency of the clock signal CLK. The serial-to-parallel circuit 331 generates a set of command signals according to the packet D1~D4 and the clock signal 7CLK. The set of command signals comprises the image signal Data, the timing command signal DE, the horizontal synchronous signal Hs, and the vertical synchronous signal Vs.

In the transmitting circuit 340, the transmitting circuit 340 transmits RSDS signals to the display according to the horizontal synchronous signal Hs', the vertical synchronous signal Vs, a timing command signal DE', and the image signal Data'.

The processor 310 receives the clock signal CLK, the timing command signal DE, the horizontal synchronous signal Hs, the vertical synchronous signal Ds, and the image signal Data. After the processor 310 arranges the received signals, the processor 310 accordingly generates the horizontal synchronous signal Hs', the vertical synchronous signal Vs, timing command signal DE', and the image signal Data'. The power-saving module 311 receives the timing command signal DE and the clock signal. The power-saving module 311 is informed if the current received image signal Data falls in the porch. For example, if the timing command signal DE is at a first voltage level, the power-saving module 311 determines that the current received image signal Data falls in the porch; if not, the power-saving module 311 determines that the current received image signal Data does not fall in the porch. If the power-saving module 311 determines that the current received image signal Data falls in the porch, the processor 310 (the power-saving module 311) transmits a control signal SW1 to the control end C of the switch 321 to turn off the switch 321. Consequently, the coupling between the power supply $V_{CC}$ and the receiving circuit 330 is cut off, and the receiving circuit 330 is then turned off. In this way, power consumption of the receiving circuit 330 during the porch is saved. Additionally, the PLL 334 consumes the most power in the receiving circuit 330. After turning off the receiving circuit 330, the processor 310 cannot determine when to turn on the receiving circuit 330 again, since the receiving circuit 330 is turned off and the processor 310 does not receive the timing command signal. Therefore, a counter 312 (not shown) is designed in the present invention to control the time length of the control signal SW1 so as to avoid the turned-off period of the receiving circuit 330 being longer than the period the image Data falling in the porch and avoid losing image signals of valid pixels. The turned-off period of the receiving circuit 330 can be determined by the processor 310. For example, the processor 310 can receive image data of a plurality of frames, and then determine the period of the porch of the frames according to the timing command signal DE so as to set the counter 312 to trigger at a particular number. After the counter 312 reaches the particular number, the processor 310 stops transmitting the control signal SW1 and the receiving circuit 330 is turned on again.

Similarly, the processor generates the timing command signal DE, the horizontal synchronous signal Hs', the vertical synchronous signal Vs' and the image signal Data' according to the received clock signal CLK, the timing command signal DE, the horizontal synchronous signal Hs, the vertical synchronous signal Vs, and the image signal Data. The power-saving module 311 receives the timing command signal DE and the clock signal CLK and is accordingly informed if the current generated image signal Data' falls in the porch. If the current generated image signal Data' falls in the porch, the processor (power-saving module 311) transmits a control signal SW2 to the control end C of the switch 322 to turn off the switch 322. Consequently, the coupling between the power supply $V_{CC}$ and the transmitting circuit 340 is cut off and the transmitting circuit 340 is then turned off. In this way, the power consumption of the transmitting circuit 340 is saved. After the transmitting circuit 340 is turned off, the transmitting circuit 340 can be turned on again when the image signal Data' does not fall in the porch. In this way, the period of time of the control signal SW2 is effectively controlled.

Figure 4:
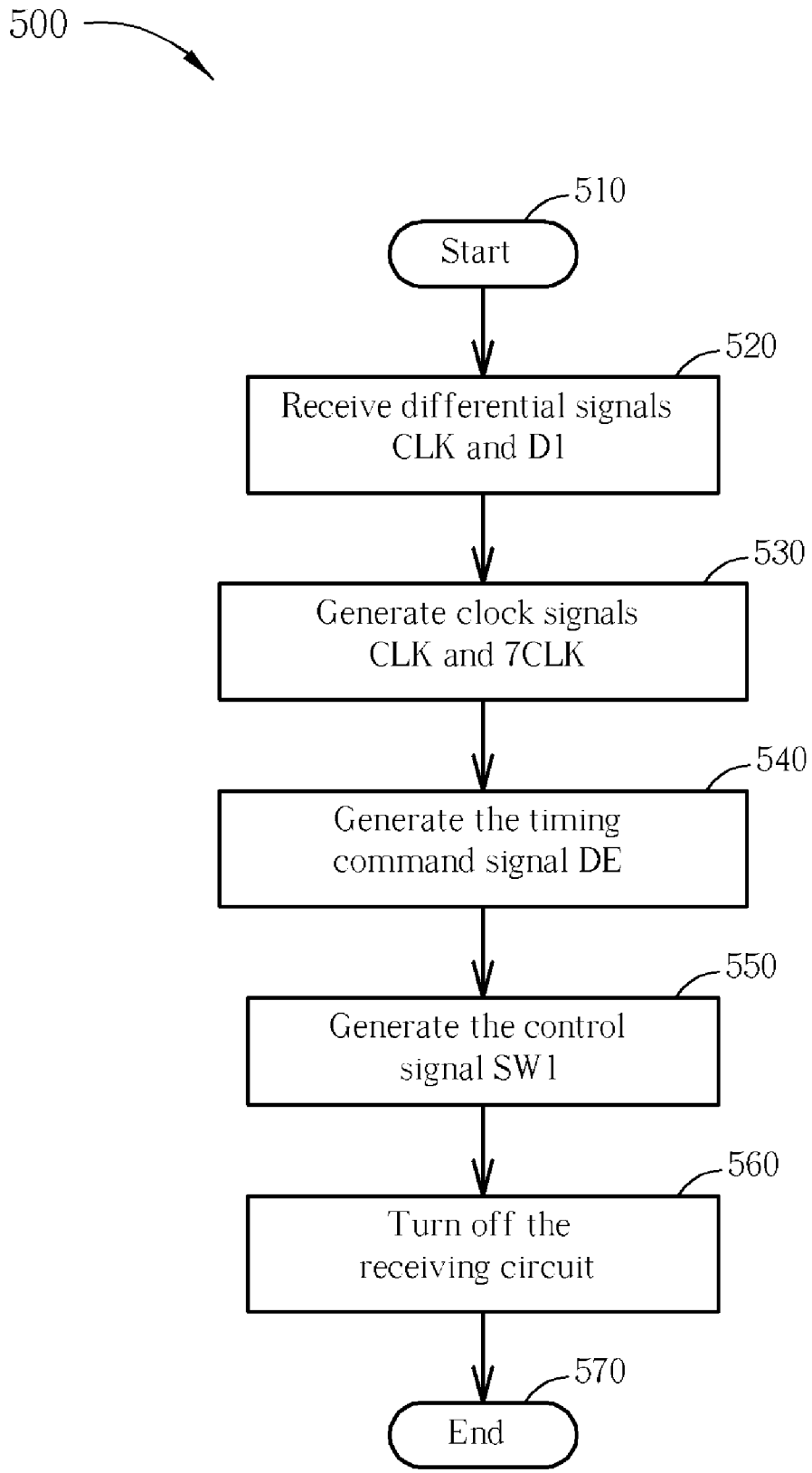
FIG. 4 is a flowchart of a method for controlling the timing control circuit with the power-saving function of the first embodiment of the present invention.

Please refer to FIG. 4. FIG. 4 is a flowchart of a method 500 for controlling the timing control circuit with the power-saving function of the first embodiment of the present invention. The steps are described as follows:

Step 510: Start.

Step 520: Receive a set of differential clock signals CLK and a set of differential data signals D1.

Step 530: Generate a clock signal CLK and the clock signal 7CLK with seven times the frequency of the clock signal CLK.

Step 540: Generate the timing command signal DE according to the clock signal 7CLK and the differential signals D1.

Step 550: Generate the control signal SW1 according to the clock signal CLK and the timing command signal DE.

Step 560: Turn off the receiving circuit 330 when receiving the control signal SW1.

Step 570: End.

Figure 5:
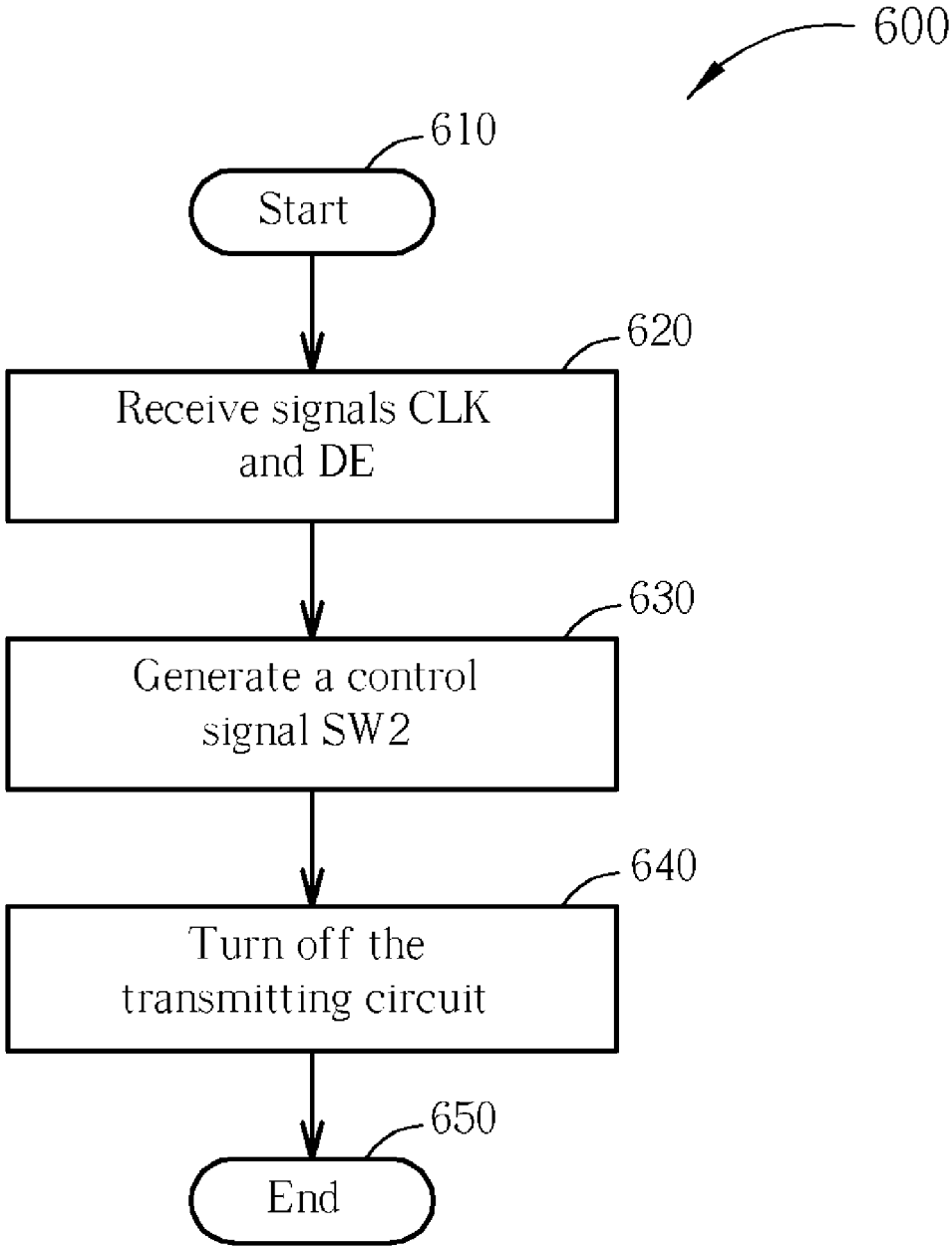
FIG. 5 is a flowchart of a method for controlling the timing control circuit with the power-saving function of the first embodiment of the present invention.

Please refer to FIG. 5. FIG. 5 is a flowchart of a method 600 for controlling the timing control circuit with the power-saving function of the first embodiment of the present invention. The steps are described as follows:

Step 610: Start.

Step 620: Receive a clock signal CLK and a timing command signal DE.

Step 630: Generate a control signal SW2 according to the clock signal CLK and the timing command signal DE.

Step 640: Turn off the transmitting circuit 340 when receiving the control signal SW2.

Step 650: End.

To sum up, the timing control circuit of the present invention effectively turns off the receiving circuit and the transmitting circuit, which saves power and provides great convenience.

Those skilled in the art will readily observe that numerous modifications and alterations of the device and method may be made while retaining the teachings of the invention.

What is claimed is:

1. A timing control circuit with a power-saving function comprising:

a receiving circuit for receiving a first set of differential signals for generating a set of command signals;

a processor coupled to the receiving circuit for generating a first control signal according to the set of command signals; and a first switch coupled to the receiving circuit and the processor for selectively cutting off coupling between the receiving circuit and a first power supply according to the first control signal;

wherein the receiving circuit is a Low Voltage Differential Signal (LVDS) receiving circuit.

2. The timing control circuit of claim 1, wherein when the first control signal is at a first voltage level, the first switch cuts off the coupling between the receiving circuit and the first power supply.

3. The timing control circuit of claim 1, wherein the first set of differential signals comprises a set of differential data signals and a set of differential clock signals, the set of command signals comprises a first clock signal and a timing command signal, and the receiving circuit generates the timing command signal according to the set of differential data signals, the receiving circuit generates the first clock signal according to the set of differential clock signals, and the processor generates the first control signal according to the timing command signal.

4. The timing control circuit of claim 3, wherein the processor generates the first control signal further according to the first clock signal.

5. A timing control circuit with a power-saving function, comprising:

a processor for receiving a set of command signals and accordingly generating a control signal;

a transmitting circuit coupled to the processor; and a switch coupled to the transmitting circuit and the processor for selectively cutting off coupling between the transmitting circuit and a power supply;

wherein the transmitting circuit is a Reduced Swing Differential Signal (RSDS) transmitting circuit.

6. The timing control circuit of claim 5, wherein the set of command signals comprises a first clock signal and a timing command signal, and the processor generates the control signal according to the timing command signal.

7. The timing control circuit of claim 6, wherein the processor generates the control signal further according to the first clock signal.

8. The timing control circuit of claim 5, wherein when the control signal is at a first voltage level, the switch cuts off the coupling between the transmitting circuit and the power supply.

9. A method for controlling a timing control circuit, the timing control circuit comprising a Low Voltage Differential Signal (LVDS) receiving circuit, the method comprising:

(a) receiving a first set of differential signals for generating a set of command signals;

(b) generating a first control signal according to the set of command signals; and (c) selectively cutting off coupling between the LVDS receiving circuit and a first power supply according to the first control signal.

10. The method of claim 9, wherein the set of command signals comprises a first clock signal and a timing command signal, and the step (b) comprises generating the first control signal according to the timing command signal.

11. The method of claim 10, wherein the step (b) further comprises generating the first control signal according to the first clock signal.

12. A method for controlling a timing control circuit, the timing control circuit comprising a Reduced Swing Differential Signal (RSDS) transmitting circuit, the method comprising:

(a) generating a control signal according to a set of command signals; and (b) selectively cutting off coupling between the RSDS transmitting circuit and a power supply according to the control signal.

13. The method of claim 12, wherein the set of command signals comprises a first clock signal and a timing command signal, and the step (a) comprises generating the control signal according to the timing command signal.

14. The method of claim 13, wherein the step (a) further comprises generating the control signal according to the first clock signal.

15. The method of claim 12, wherein when the control signal is at a first voltage level, a switch cuts off the coupling between the RSDS transmitting circuit and the power supply.

* * * * *